US009051146B2

(12) United States Patent
Malmi

(10) Patent No.: US 9,051,146 B2
(45) Date of Patent: Jun. 9, 2015

(54) METHOD AND DEVICE FOR WINDING OF FIBER WEBS, ESPECIALLY OF PARTIAL PAPER AND BOARD WEBS

(71) Applicant: Jarmo Malmi, Järvenpää (FI)

(72) Inventor: Jarmo Malmi, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 204 days.

(21) Appl. No.: 13/866,924

(22) Filed: Apr. 19, 2013

(65) Prior Publication Data

US 2013/0277489 A1 Oct. 24, 2013

(30) Foreign Application Priority Data

Apr. 20, 2012 (EP) ..... 12164937

(51) Int. Cl.

| | |
|---|---|
| ***B65H 18/14*** | (2006.01) |
| ***B65H 18/08*** | (2006.01) |
| ***B65H 18/16*** | (2006.01) |
| ***B65H 18/26*** | (2006.01) |

(52) U.S. Cl.

CPC ..... *B65H 18/08* (2013.01); *B65H 18/16* (2013.01); *B65H 18/26* (2013.01); *B65H 2301/4148* (2013.01); *B65H 2301/41486* (2013.01); *B65H 2301/414863* (2013.01); *B65H 2402/32* (2013.01); *B65H 2404/432* (2013.01); *B65H 2404/434* (2013.01); *B65H 2557/264* (2013.01)

(58) Field of Classification Search

CPC ..... B65H 18/14; B65H 18/16; B65H 18/26
USPC ..... 242/541, 541.1, 541.4–541.5, 530.4
See application file for complete search history.

(56) References Cited

U.S. PATENT DOCUMENTS

| | | | | | |
|---|---|---|---|---|---|
| 3,604,649 | A | * | 9/1971 | Dorfel | 242/541.6 |
| 3,792,824 | A | | 2/1974 | Meyer et al. | |
| 3,837,593 | A | * | 9/1974 | Dorfel | 242/534 |
| 4,095,755 | A | * | 6/1978 | Snygg et al. | 242/541.6 |
| 4,105,170 | A | | 8/1978 | Schönmeier | |
| 4,394,990 | A | * | 7/1983 | Kildal et al. | 242/532 |
| 4,440,356 | A | | 4/1984 | Lang | |
| 4,550,887 | A | | 11/1985 | Schonmeier | |

(Continued)

FOREIGN PATENT DOCUMENTS

| | | | |
|---|---|---|---|
| EP | 0711245 | A1 | 5/1996 |
| EP | 12164937 | | 4/2012 |
| WO | 9855383 | A1 | 12/1998 |

OTHER PUBLICATIONS

European Search Report for EP12164937 dated Aug. 8, 2012.

*Primary Examiner* — Sang Kim
(74) *Attorney, Agent, or Firm* — Stiennon & Stiennon

(57) ABSTRACT

Fiber webs are wound into partial web rolls (15) in a winding device having at least two winding stations (20) and rider roll units (30) that load a pair of rider rolls (31,32) against the partial web roll (15) being wound. The partial webs (W1, W2) are guided to be wound to partial web rolls (15) around cores (14) via a nip between a winding roll (10) and the partial web rolls (15). The winding position of the partial web rolls (15) is on the upper circumferential half of the winding roll (10). The rider rolls (31, 32) are moved substantially linearly in the direction of the radius of the partial web rolls (15) and co-linear with a movement path of winding chucks (25) on which the partial web rolls are supported at the two ends of a core (14).

15 Claims, 5 Drawing Sheets

(56) References Cited

U.S. PATENT DOCUMENTS

| | | | | |
|---|---|---|---|---|
| 4,601,435 | A | 7/1986 | Tomma et al. | |
| 5,364,044 | A | 11/1994 | Welp et al. | |
| 5,405,099 | A | 4/1995 | Hehner et al. | |
| 5,732,902 | A * | 3/1998 | Tomma et al. | 242/541.5 |
| 5,806,783 | A * | 9/1998 | Turunen | 242/530.1 |
| 6,007,014 | A * | 12/1999 | Kruger | 242/418 |
| 6,012,673 | A | 1/2000 | Kayser et al. | |
| 6,170,777 | B1 * | 1/2001 | Dorfel et al. | 242/541.5 |
| 6,349,897 | B1 * | 2/2002 | Sinkko et al. | 242/541.5 |
| 6,427,940 | B1 * | 8/2002 | Koutonen et al. | 242/541.5 |

* cited by examiner

METHOD AND DEVICE FOR WINDING OF FIBER WEBS, ESPECIALLY OF PARTIAL PAPER AND BOARD WEBS

CROSS REFERENCES TO RELATED APPLICATIONS

This application claims priority on European App. No. EP12164937, filed Apr. 20, 2012, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method and apparatus for winding fiber webs, particularly partial paper and board webs, into partial web rolls, in which method, partial web rolls are wound via a nip between a winding roll and the partial web roll being formed on a winding station in connection with the winding roll.

It is known that a fiber web, e.g. paper, is manufactured in machines which together constitute a paper-manufacturing line which can be hundreds of meters long. Modern paper machines can produce over 450,000 tons of paper per year. The speed of the paper machine can exceed 2,000 m/min and the width of the paper web can be more than 11 meters.

In paper-manufacturing lines, the manufacture of paper takes place as a continuous process. A paper web completing in the paper machine is reeled by a reel-up around a reeling shaft, i.e. a reel spool, into a parent roll the diameter of which can be more than 5 meters and the weight more than 160 tons. The purpose of reeling is to modify the paper web manufactured as planar to a more easily processable form. On the reel-up located in the main machine line, the continuous process of the paper machine breaks for the first time and shifts into periodic operation.

The web of the parent roll produced in paper manufacture is full-width and even more than 100 km long so it must be slit into partial webs with suitable width and length for the customers of the paper mill and wound around cores into so-called customer rolls before delivering them from the paper mill. This slitting and winding up of the web takes place as known in an appropriate separate machine, i.e. a slitter-winder.

On the slitter-winder, the parent roll is unwound, the wide web is slit on the slitting section into several narrower partial webs which are wound up on the winding section around winding cores, such as spools, into customer rolls. When the customer rolls are completed, the slitter-winder is stopped and the wound rolls (i.e. the so-called set) are removed from the machine. Then, the process is continued with the winding of a new set. These steps are repeated periodically until paper runs out of the parent roll, whereby a parent roll change is performed and the operation starts again as the unwinding of a new parent roll.

Slitter-winders employ winding devices of different types depending on, inter alia, the type of the fiber web being wound. On slitter-winders of the multi-station winder type, the web is guided from the unwinding via guide rolls to the slitting section where the web is slit into partial webs which are further guided either from above or from below to the winding roll/rolls of the winding stations to be wound up onto cores into customer rolls. Adjacent partial webs are wound up on different sides of the winding roll/rolls. Multistation winders have one to three winding rolls and in them each partial web is wound to a partial web roll in its own winding station. During winding a winding nip is formed between the winding roll and the partial web roll to be wound.

In winding the winding nip between the partial web roll to be wound and the winding roll tightens the web in the area of the nip. If the nip load is uneven in width of the partial web roll i.e., in the axial direction of the partial web roll, the web tightens unevenly and causes creases and wrinkles at the bottom of the partial web roll. This problem is very difficult in winders with soft winding rolls i.e., winding rolls that have a surface layer of soft coating material.

Some multistation winder types of prior art are disclosed in patent publications U.S. Pat. Nos. 3,792,824, 5,405,099, 6,012,673, 4,550,887, 4,601,435, and EP 0711245. In these prior art arrangements the partial web rolls are wound on the upper half of the circumference of the winding roll, except in the arrangement of U.S. Pat. No. 3,792,824 in which the partial rolls are wound at the side of the winding roll. In these prior arrangements winding stations are equipped with center drives, which are used during winding.

Multistation winders may also comprise rider rolls that are used for creating further load at the beginning of the winding against the winding roll and for preventing the cores from bending. The rider rolls are used to create a uniform nip load and for avoiding too high loading of core chucks used for attaching the ends of the cores at the ends of cores/partial web rolls, which would cause problems in the bottom of the partial web rolls i.e., in the beginning layers of the partial web roll to be wound, which problems are common in winding.

In winding when the partial web roll has achieved enough stiffness the influence of the rider rolls decreases. In prior art arrangements typically the loading of rider rolls can be used up to certain diameters of the partial web rolls, usually up to the diameters of 250-450 mm.

In prior art arrangements the multistation winders have typically been provided by a center drive system connected to the core chucks, whereby the torque of the core chucks has been used to tighten the web to be wound on the partial web roll. It is known that by constant center torque the circumferential force is inversely proportional to the diameter of the web roll and thus it decreases as the diameter of the web roll increases. The endurance ability of the cores limits the torque transmittable from the chucks and thus the center torque is limited in its ability to control/adjustment of the tightness of the partial web roll.

From the prior art is also known multistation winders in which rider roll devices with integrated extra drives are used for creating surface traction effective on the surface of the partial web roll. In these prior art arrangements it has been possible to partially control/adjust the tightness of the partial web roll to be wound by this surface traction of the rider rolls. This kind of prior art arrangement is disclosed for example in EP patent 0711245, in which the rider rolls are in the beginning of the winding used for loading and supporting of the partial web roll to be wound and as the winding proceeds the rider rolls are moved downward along a part in direction of the circumference of the web roll and at the end of the winding the rider rolls support the web roll to be finished from below. In this prior art arrangement the surface traction can be used during the whole winding process. This winding arrangement is as a constructional structure, expensive and the rider rolls can be used for loading only up to the web roll diameters of about 450 mm. Also the surface traction needs to be limited at the stage, when the rider rolls are at the side of the partial web roll when moving along the circumference of the web roll to the, from below, supporting position.

In prior art multistation winders U.S. Pat. Nos. 3,792,824, 5,405,099, 6,012,673, 4,550,887 and U.S. Pat. No. 4,601,435 the rider rolls have no separate drives thus surface traction cannot be used.

In prior art arrangements of multistation winders of the type disclosed in U.S. Pat. No. 4,601,435 the rider rolls move some way in linear path before the rider roll beam supporting the rider rolls is lifted up but as in these types of multistation winders the center of the partial web roll to be wound moves a curved path due to pivoted winding arm i.e. the winding nip between the partial web roll and the winding roll moves during winding on the circumference of the winding roll downwards, the movement direction and movement area of the rider rolls must be optimized to be used at the most important stage of winding, i.e. at the beginning of the winding.

It has proven that discontinuing the loading of the rider rolls at this early stage causes problems and there would be a need to use the loading of the rider rolls during a longer period of the winding. It would be very advantageous if the loading of the rider roll could be used during the whole winding period of the partial web roll, especially in connection with certain fiber web grades, for example.

SUMMARY OF THE INVENTION

Thus an object of the invention is to create a device and a method for winding fiber webs where the rider roll loading can be used during the whole period of winding the partial web roll.

An object of the invention is to create a device and a method for winding fiber webs where the limited use of the rider roll loading and the limited use of surface traction of the rider rolls are eliminated.

An object of the invention is to provide a device and a method for winding fiber webs where the result of the winding is the best possible and similar in all simultaneously wound partial web rolls.

To achieve the above-mentioned objects and those which come out later, in the method of the invention rider rolls are moved linearly in the direction of the radius of the partial web roll and co-linear with the movement path of the winding chucks on which the partial web roll is supported at ends of its core and the partial web rolls are loaded and supported by the rider rolls in the direction of the center of the partial web roll from the beginning of the winding until the, partial web rolls are wound to the end diameter. The device according to the invention comprises guides on which the rider rolls are moved linearly in the direction of the radius of the partial web roll and co-linear with the movement path of the winding chucks on which the partial web roll is supported at ends of its core for supporting and loading the partial web rolls in the direction of the center of the partial web roll from the beginning of the winding until the partial web rolls are wound to the end diameter.

According to the invention the rider rolls are moved substantially linearly in the direction of the radius of the partial web roll and the partial web rolls are loaded and supported by the rider rolls in the direction of the center of the partial web roll from the beginning of the winding until the partial web rolls are wound to the end diameter.

According to an advantageous feature of the invention by the rider rolls surface traction is provided for controlling/adjusting the tightness of the partial web rolls during the whole winding process.

The invention relates to a method and a device of winding partial fiber web rolls which winding is advantageously multistation winder type winding and in which the winding position of the partial web rolls to be wound is on the upper circumferential half of the winding rolls on winding stations. The device comprises one or two winding rolls and the partial web rolls to be wound are alternating on each side of the device as in such known from prior art multistation winder types.

According to an advantageous aspect of the invention each winding station comprises two winding carriages in which winding arms with winding heads/winding chucks are positioned and move along a linear path when the diameter of the partial web roll increases. Each carriage is provided with a separate loading/relief-device and each winding station comprises force measurement of loading and force feedback control based on results of the force measurement.

According to an advantageous aspect of the invention the winding stations are movable in the width direction of the winder i.e. in the axial direction of the partial web rolls.

According to an advantageous aspect of the invention on both sides of the winder linearly up and down movable cross-directional beams are provided. On the beams are attached rider roll units that load a pair of rider rolls against the partial web roll to be wound. The rider rolls are movable in the vertical direction of guides attached to the rider roll unit. Each rider roll unit is provided by a separate loading device.

According to an advantageous aspect of the invention a drive motor is connected to the rider rolls of the rider roll unit by which arrangement the surface of the partial web roll to be wound can be loaded with a circumferential force, i.e. the surface traction can be provided.

According to an advantageous aspect of the invention the rider roll units can be provided with force measurement of loading and with force feedback control/adjustment based on the force measurement results.

According to an advantageous aspect of the invention the rider roll units are movable in the cross-direction, i.e. in the width direction of the winder, on guides attached to the cross-directional beam.

In the method according to an advantageous aspect of the invention during winding the center of the partial web roll to be wound and thus the winding chucks move along a linear path as the diameter of the partial web roll increases. The movement path of the rider rolls is also linear and substantially co-linear with the movement path of the chucks. In the beginning of the winding by the rider rolls the partial web roll to be wound around the cores is supported and loaded as well as the partial web is tightened by the surface traction. As the winding progresses the rider rolls move substantially linearly in direction of the radius of the partial web roll to be wound supporting and loading the partial web roll to be wound until the end diameter of the partial web roll is achieved and simultaneously tightening the partial web to be wound by the surface traction.

By the invention is achieved a method and a device of winding a partial fiber web roll where exists no limit to the diameter of the partial web roll for using the rider rolls and thus disadvantages and problems of prior art arrangements can be eliminated. In addition the surface traction can be used effectively during the whole winding process and thus the problems relating to the center drive use can be avoided and a circumferential force that is freely controllable/adjustable independent of the diameter of the partial web roll by which the tightness of the partial web roll can effectively be controlled/adjusted.

According to an advantageous feature of the invention, winding up occurs utilizing the mass of the roll and, as the roll diameter increases, its center moves linearly at a certain angle in relation to the winding roll, whereby the position of the nip remains stationary. The winding stations are advantageously sturdily supported directly on the machine level floor or equivalent foundation.

According to an advantageous additional characteristic of the invention, the winding stations are directly supported on the floor, thus providing them an extremely good and stable support without massive support structures above the machine floor level.

Next, the invention will be described in more detail with reference to the figures of the enclosed drawing, to the details of which the invention is intended by no means to be narrowly limited.

DESCRIPTION OF THE PREFERRED EMBODIMENTS

Figure 3:
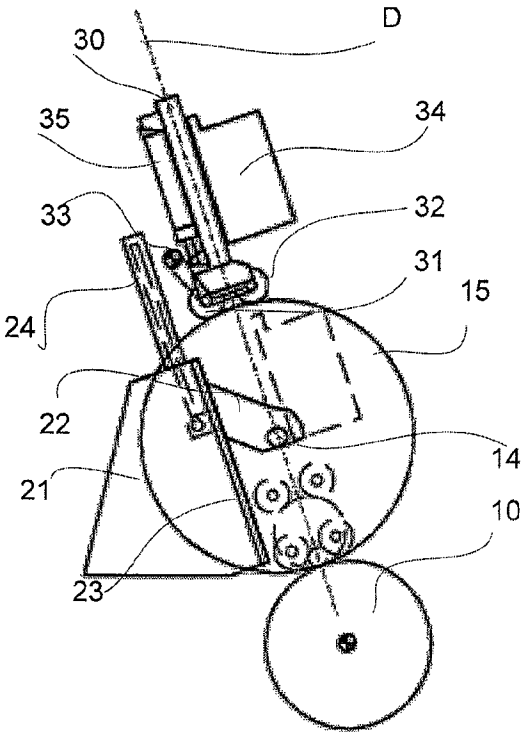
FIG. 3 shows schematically a winding station with rider rolls according to the invention where winding is substantially complete.
Figure 2:
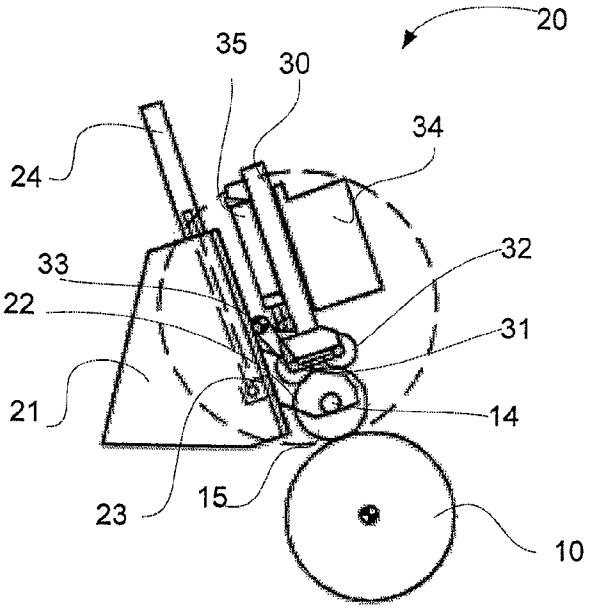
FIG. 2 shows schematically a winding station with rider rolls according to the invention where winding is partially complete.
Figure 1:
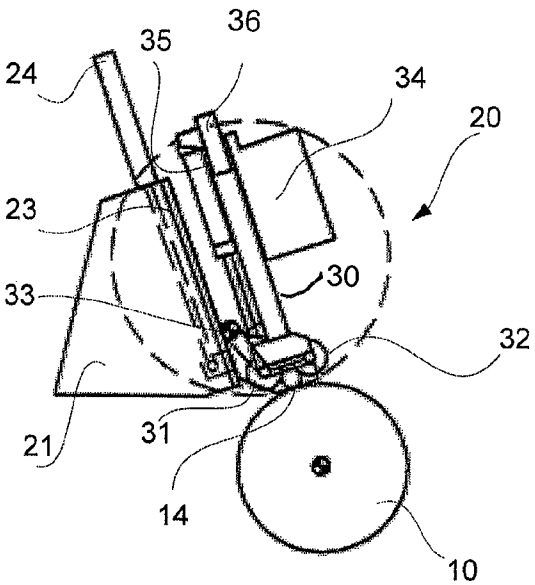
FIG. 1 shows schematically a winding station with rider rolls according to the invention where winding is just starting.

FIG. 1-3 schematically show an exemplifying embodiment of the invention. In the figures only one carriage of one winding station 20, one rider roll unit 30 and one winding roll 10 are shown. By the same reference signs in the FIGS. 1-6 are denoted corresponding parts and combinations unless otherwise mentioned.

Figure 2A:
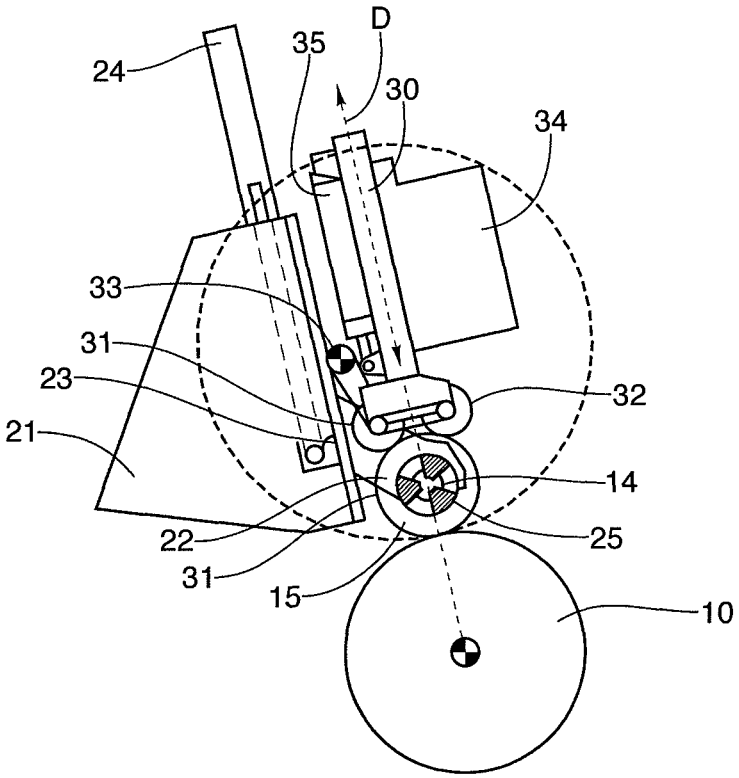
FIG. 2*a* is an enlarged detailed schematic view of the arrangement of FIG. 2.

In the winder, the winding position of the partial web rolls 15 to be wound is on the upper circumferential half of the winding roll 10 on winding stations 20. The device for winding i.e., the winder, comprises one or two winding rolls 10; in the example of FIGS. 1-3, only one winding roll of a two winding roll 10 winder is shown. In the winder the other winding roll is located next to the winding roll 10 shown in the figures in a mirror like position so that partial web rolls 15 and the winding rolls 10 are facing each other and the partial web rolls 15 to be wound alternating on each side of the device. Each winding station 20 comprises two winding carriages 21. As shown in FIG. 2*a*, in each carriage winding heads/winding chucks 25 supported by winding arms 22 are positioned. The winding chucks 25 move along a linear path as the arm 22 moves on the linear guide 23 supported on the carriage 21, this movement occurs when the diameter of the partial web roll 15 increases as winding proceeds around the cores 14. Each carriage 21 is provided with a separate loading/relief-device 24 and each winding station 20 comprises force measurement of loading (not shown) and force feedback control (not shown) based on results of the force measurement. The winding stations 20 are movable in the width direction of the winder i.e. in the axial direction of the partial web rolls 15.

On both sides of the winder linearly up-and-down-movable cross-directional beams 34 are provided (only one being shown in the FIGS. 1-3, the other is located in connection with the other side winding stations on the other winding roll/on the other side of the winding roll). Rider roll units 30 mounted to liner guides 36 are attached to the cross beams 34. The rider roll units 30 load a pair of rider rolls 31, 32 against the partial web roll 15 to be wound. Each rider roll unit is provided by a separate loading device 35. A drive motor 33 is connected to the rider roll unit 30 and rider rolls 31, 32 by which arrangement the surface of the partial web roll 15 to be wound can be loaded with circumferential force i.e. the surface traction can be provided. The rider roll units 30 can be provided with force measurement of loading and with force feedback control/adjustment based on the force measurement results. The rider roll units 30 are movable in the cross-direction, i.e. in the width direction of the winder, on guides (not shown) attached to the cross-directional beam 34.

During winding the center of the partial web roll 15 to be wound and thus the winding chucks 25 on the arms 22 move along a linear path D (shown in FIGS. 2*a* and 3) as the diameter of the partial web roll 15 increases. The movement path of the rider rolls 31, 32 is also linear and substantially co-linear with the movement path of the chucks 25.

In the beginning of the winding by the rider rolls 31, 32, see FIG. 1, the partial web roll 15 to be wound around the core 14 is supported and loaded as well, as the partial web is tightened by the surface traction. As the winding progresses, see FIG. 2, the rider rolls 31, 32 move substantially linearly in the direction of the radius of the partial web roll 15 being wound, supporting and loading the partial web roll 15 to be wound until the end diameter of the partial web roll 15 is achieved, see FIG. 3, while simultaneously tightening the partial web to be wound by the surface traction.

The web roll 15 is created around a core 14 or equivalent winding spool which is connected from its center to the winding arm 22. As the web roll grows when the winding proceeds, the center, i.e. the core 14 of the growing web roll 15, moves linearly upwards, along the line D as shown in FIG. 3. The winding up of the partial web into the partial web roll 15 occurs utilizing the mass of the partial web roll 15 as the partial web roll supports itself, advantageously at least a part of its mass, on the winding roll 10 below. Hence, the mass of the web roll 15 provides the nip load required for winding between the web roll 15 and the winding roll 10. The extra part of the mass of the web roll 15 is supported and relieved by winding chucks 25 on the winding arm 22. The winding chucks 25 on the winding arm 22 support the partial web roll 15 from the center of the web roll by the core 14.

Figure 4:
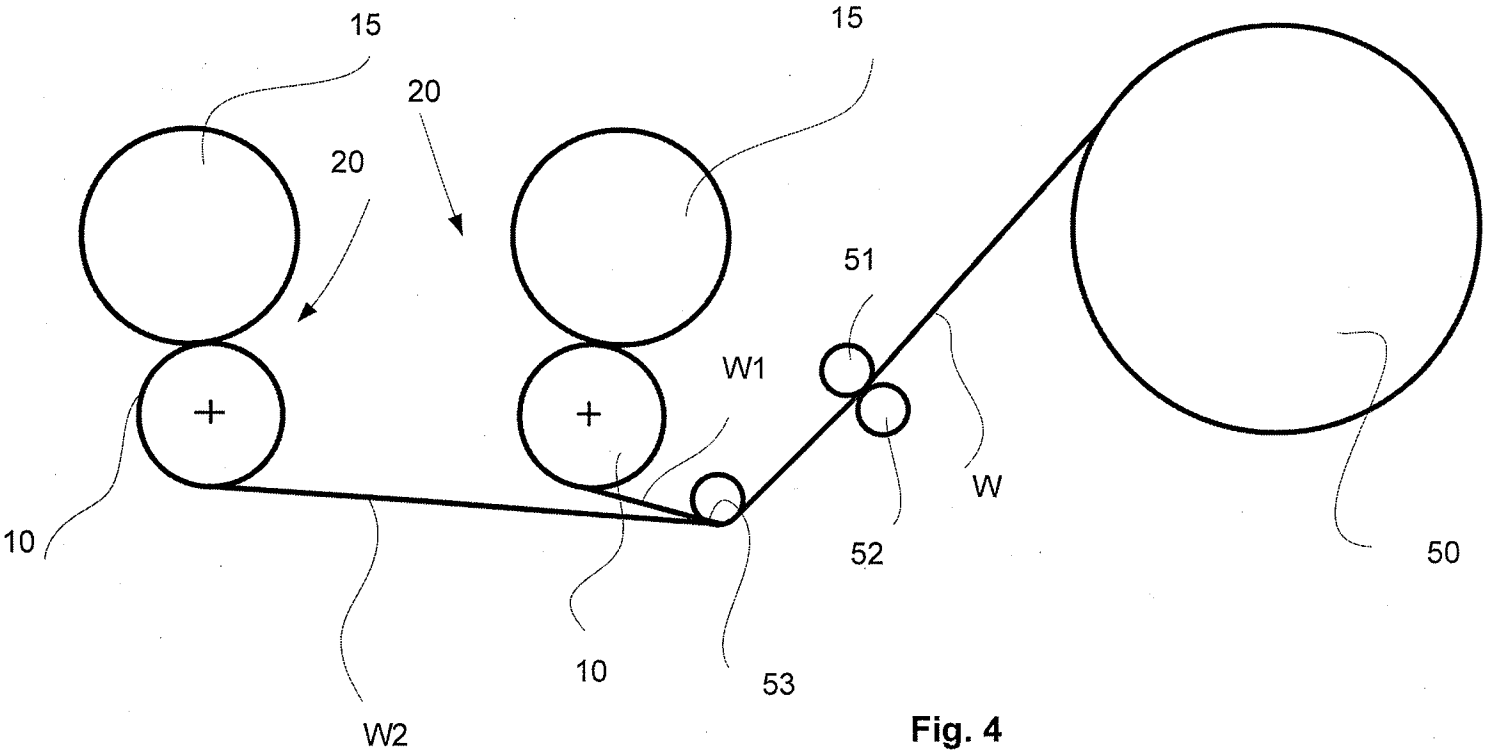
FIG. 4 shows schematically an example of a device for winding partial webs onto partial webs rolls with two winding rolls in which the invention is applicable.

FIG. 4 schematically shows an exemplifying embodiment of the invention in which two winding rolls 10 are used. A web W is guided for example from an unwinding station 50 in between slitter blades 51, 52 or laser or water jet slitting means which slit the web W in the longitudinal direction into partial webs W1, W2. By reference sign W1 are indicated those partial webs that will be guided from the guide roll 53 to the first winding station 20 to be wound into first partial web rolls 15 and by reference sign W2 are indicated those partial webs that will be guided from the guide roll 53 to the second winding station 20 to be wound into second partial web rolls 15. The partial webs W1, W2 are wound into partial web rolls 15 via the winding rolls 10 on respective winding stations 20. Each partial web roll is created around a core 15 or equivalent winding spool. Substantially all partial webs W1, W2 pass via the first guide roll 53 and all the second partial webs W1 are guided to the winding roll 10 of the first winding station 20 and the winding up thus occurs via winding roll 10 at the first winding stations 20. From the guide roll 53 the other every second partial webs W2 are guided to be wound up via the second winding roll 10 on second winding stations 20. The partial webs rolls 15 are wound on the upper half of the circumference of the winding roll 10.

Figure 5:
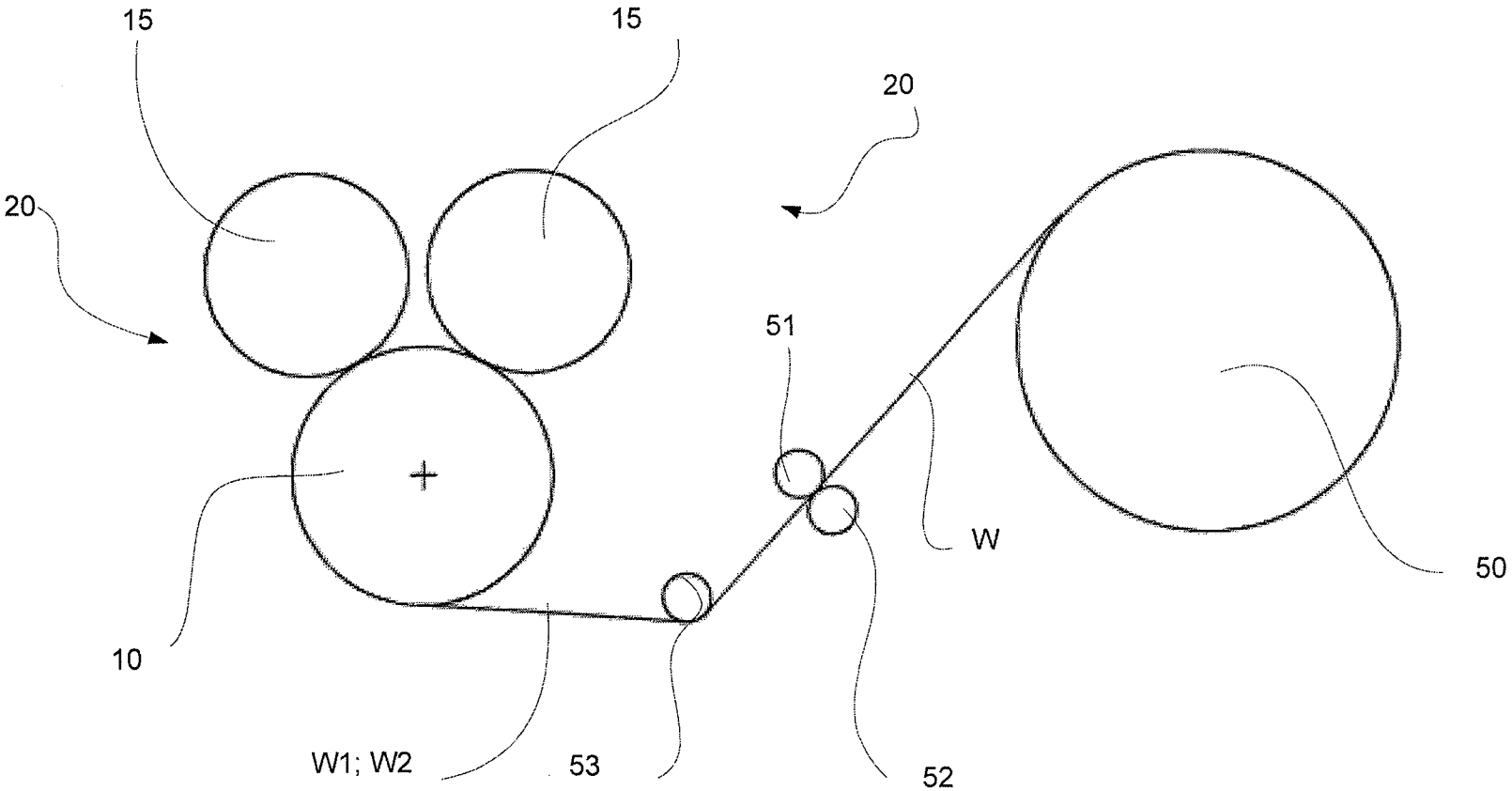
FIG. 5 shows schematically an example of a device for winding partial webs onto partial webs rolls with one winding roll in which the invention is applicable.

FIG. 5 schematically shows an exemplifying embodiment of the invention in which one winding roll 10 is used. A web W is guided for example from an unwinding station 50 in between slitter blades 51, 52 or laser or water jet slitting means which slit the web W in the longitudinal direction into partial webs W1, W2. By reference sign W1 are indicated those partial webs that will be guided from the guide roll 53 to the first winding station 20 to be wound into first partial web rolls 15 and by reference sign W2 are indicated those partial webs that will be guided from the guide roll 53 to the second winding station 20 to be wound into second partial web rolls 15. The partial webs W1, W2 are wound into partial web rolls 15 via the winding roll 10 on respective winding stations 20. Each partial web roll is created around a core or equivalent winding spool. The partial webs rolls 15 are wound on the upper half of the circumference of the winding roll 10.

Figure 6:
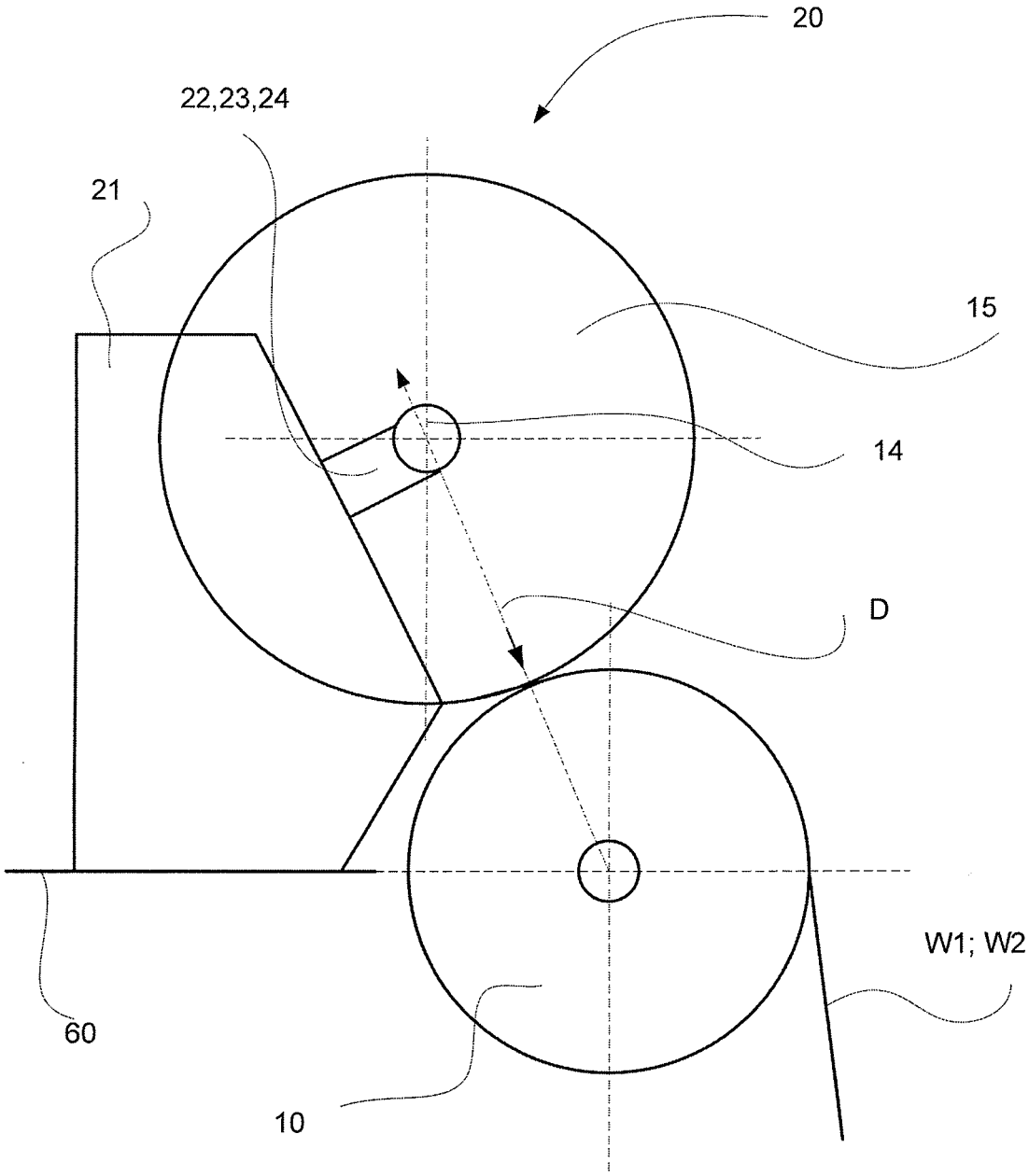
FIG. 6 shows schematically an example of a winding station for winding partial webs onto partial web rolls in which the invention is applicable.

FIG. 6 schematically shows an example of a winding station 20 supported on the floor 60. The figure shows a winding roll 10, partial webs guidable to which are designated with reference W1; W2. The partial webs W1, W2 are wound into partial web rolls 15 via the winding roll 10 on the winding station 20. The winding station 20 is supported on a floor 60 or equivalent foundation, and the web roll 10 is attached to the winding station 20 linearly movably via a support structures 21, 22, 23, 24 or equivalent. The web roll is created around a core 14 or equivalent winding spool which is connected from its center to the support structures 21, 22, 23, 24. As the web roll diameter increases when the winding proceeds, the growing web roll moves linearly in relation to the winding roll 10, along a line D as shown by arrows.

The winding stations 20 according to FIGS. 1-3 are advantageously positioned in connection with the winding rolls 10 in the example of FIG. 6. In connection in the example of FIG. 4 the winding stations 20 according to FIGS. 1-3 are located with both winding rolls 10 and in connection with the example of FIG. 5 the winding stations 20 according to FIGS. 1-3 are located with the winding roll 10.

In connection with the example of FIG. 6 and FIGS. 1-3, the other winding stations (not shown) in connection with the winding roll or the other winding roll (see FIGS. 4-5) are substantially a mirror image in relation to the winding station 20 shown in the figure.

It should be understood that in the claims, the term winding cores includes winding spools.

The invention was described above referring to only some of its advantageous exemplifying embodiments to the details of which the invention is not intended to be narrowly limited but many modifications and variations are possible.

I claim:

1. A method for winding partial paper or board webs into partial web rolls on a winding roll, wherein the winding roll defines an upper circumferential half of the winding roll, in winding stations of a winding device, the method comprising the steps of:

winding a plurality of partial webs on to partial web rolls on the upper circumferential half of the winding roll in the winding stations;

wherein each of the plurality of partial web rolls is engaged with only one winding roll;

wherein each partial web roll has a roll center and is wound about a core having two ends and is supported at the two ends by a pair of winding chucks or winding heads;

wherein during winding of the partial webs on to the partial web rolls, using a plurality of rider roll units each having a pair of driven rider rolls which are spaced apart in a direction along which the partial webs travel so as to hold the core between each of the air of rider rolls and the winding roll to prevent the core from bending;

loading each partial web roll with the pair of rider rolls of each rider roll unit;

guiding the partial webs to the partial web rolls and around the cores via nips between the winding roll and the partial web rolls;

wherein the partial web rolls are loaded and supported by the rider rolls in a direction toward the roll center of the partial web rolls from initiating of the winding on the partial winding rolls until winding of the partial web rolls is completed;

applying a circumferential force to the partial web rolls with the driven rider rolls;

moving the winding chucks or winding heads along a linear movement path as the partial web rolls are wound from initiating of the winding of the partial webs until the partial web rolls are completed; and moving the rider rolls linearly in a direction along a radius of the partial web rolls and co-linear with the movement path of the winding chucks or winding heads on which the partial web rolls are supported at the two ends of the core from initiating of the winding of the partial webs until the partial web rolls are completed.

2. The method of claim 1 wherein the partial web rolls are wound alternating on winding stations on each side of one winding roll.

3. The method of claim 1 wherein the partial web rolls are wound alternating on winding stations on each side of two different winding rolls.

4. The method of claim 1 wherein a web is guided from an unwinding station in between slitter blades and slit into the partial webs in a direction in which the web travels and wherein the partial webs are guided via a guide roll and every second partial web is guided to a first winding roll in a first winding station and every other second partial web is guided to a second winding roll in a second winding station.

5. The method of claim 1 wherein a web is guided from an unwinding station in between slitter blades and slit into the partial webs in a direction in which the web travels and wherein the partial webs are guided via a guide roll so that every second partial web is guided to the winding roll and to first winding stations and every other second partial web is guided to the winding roll and to second winding stations.

6. The method of claim 1 wherein rider roll surface traction is used for controlling or adjusting the tightness of the partial web rolls from initiating of the winding of partial webs until the partial web rolls are completed.

7. The method of claim 1 wherein the winding chucks or winding heads of the winding stations are moved along the linear path on linear guides while supported on winding carriages as the partial web rolls increase in diameter.

8. The method of claim 1 wherein the winding stations are moved along an axial direction of the partial web rolls.

9. The method of claim 1 wherein the rider roll units are movable along an axial direction of the partial web rolls on guides attached to a cross-directional beam.

10. The method of claim 1 wherein the step of applying the circumferential force to the partial web rolls with the driven rider rolls includes tightening the partial webs by surface traction provided by driving the rider rolls until the partial web rolls are completed.

11. A device for winding partial paper and board webs into partial web rolls on to cores, the device comprising:

at least one winding roll, the winding roll defining an upper circumferential half of said winding roll;

at least two winding stations, wherein the winding stations are arranged to position partial web rolls on the at least one winding roll upper circumferential half;

wherein each of the partial web rolls is engaged with only one winding roll;

each winding station further comprising:

two winding carriages, wherein each carriage has a winding chuck or winding head supported by a winding arm, and wherein the winding chucks or winding heads are mounted for movement along linear guides of the carriages so as to move along a linear movement path as the arms move on the linear guides as winding proceeds around a winding core;

a rider roll unit having a pair of rider rolls which are spaced apart in a direction along which the partial webs travel so as to hold the core between each of the pair of rider rolls and the winding roll to prevent the core from bending, the rider roll unit being mounted on a linear guide for linear movement in a direction of a partial web roll center as it engages with the at least one winding roll;

a loading device connected to load the pair of rider rolls against a partial web roll in the direction of a partial web roll center as it engages with the at least one winding roll;

a drive motor connected to the rider roll unit and connected to rotatably drive the pair of rider rolls for engagement with the surface of the partial web rolls to be wound to load said partial web rolls with circumferential force to provide surface traction;

wherein the winding carriages are arranged to support and load a partial web roll with the winding chucks or winding heads at two ends formed by a core about which a partial web roll is formed, the winding chucks or winding heads being movable along the linear movement path in the direction of a partial web roll center as it engages with the at least one winding roll; and wherein the rider rolls are movable only linearly in the direction of a partial web roll center as the partial web roll center engages with the at least one winding roll and co-linear with the linear movement path of the winding chucks.

12. The device of claim 11 wherein the at least one winding roll is only one winding roll.

13. The device of claim 11 wherein the at least one winding roll comprises at least two winding rolls.

14. The device of claim 11 wherein the linear guide to which the rider roll unit is mounted is further mounted to a cross beam.

15. The device of claim 11 wherein each rider roll unit is provided with a separate loading device.

* * * * *

UNITED STATES PATENT AND TRADEMARK OFFICE

CERTIFICATE OF CORRECTION

PATENT NO. : 9,051,146 B2
APPLICATION NO. : 13/866924
DATED : June 9, 2015
INVENTOR(S) : Jarmo Malmi It is certified that error appears in the above-identified patent and that said Letters Patent is hereby corrected as shown below:

In the Claims

Column 8, line 10, "between each of the air of rider rolls" should be -- between each of the pair of rider rolls --.

Signed and Sealed this
Sixth Day of October, 2015

Michelle K. Lee

Michelle K. Lee
*Director of the United States Patent and Trademark Office*